United States Patent [19]

Perretta

[11] 4,270,161

[45] May 26, 1981

[54] LIGHTING APPARATUS

[75] Inventor: Michael L. Perretta, Manlius, N.Y.

[73] Assignee: Crouse-Hinds Company, Syracuse, N.Y.

[21] Appl. No.: 47,266

[22] Filed: Jun. 8, 1979

[51] Int. Cl.[3] ..... F21V 21/00

[52] U.S. Cl. ..... 362/249; 362/219; 362/225; 362/388

[58] Field of Search ..... 362/219, 249, 225, 388

[56] References Cited

U.S. PATENT DOCUMENTS 4,052,806 10/1977 George ..... 362/224

*Primary Examiner*—Stephen J. Lechert, Jr.

*Attorney, Agent, or Firm*—Jacobi, Lilling, Siegel & Presta

[57] ABSTRACT

Lighting apparatus comprising a long span lightweight luminaire beam with a cross section that is substantially in the shape of an equilateral triangle and is formed in multiple sections secured together. One apex of the triangle is pointed downwardly. The side panels of the beam are used as mounting and reflecting surfaces for fluorescent lights or the like, while the ballast and wiring are mounted inside the beam to protect them from weather. The mounting hole for the ballast also serves as the access hole for assembly of the span, and the ballast may be inverted in its mounting for servicing. The beam is supported in an elevated, substantially horizontally extending position by one or more support posts. This apparatus is particularly advantageous for use in illuminating large outdoor areas such as tennis courts.

11 Claims, 10 Drawing Figures

FIG. 6
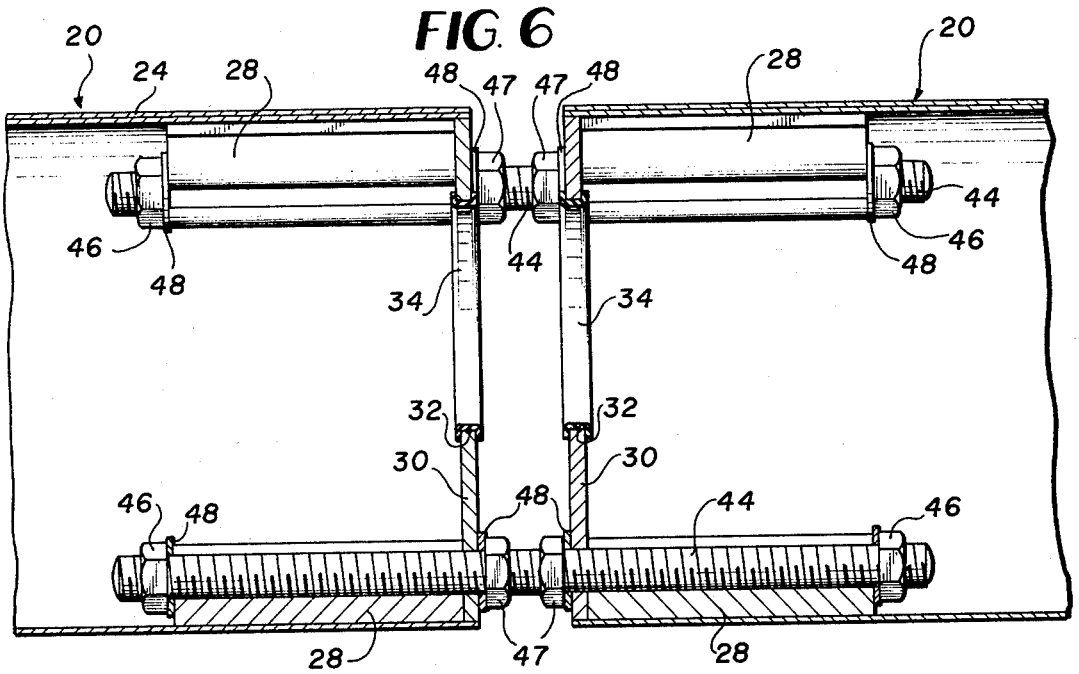
FIG. 7
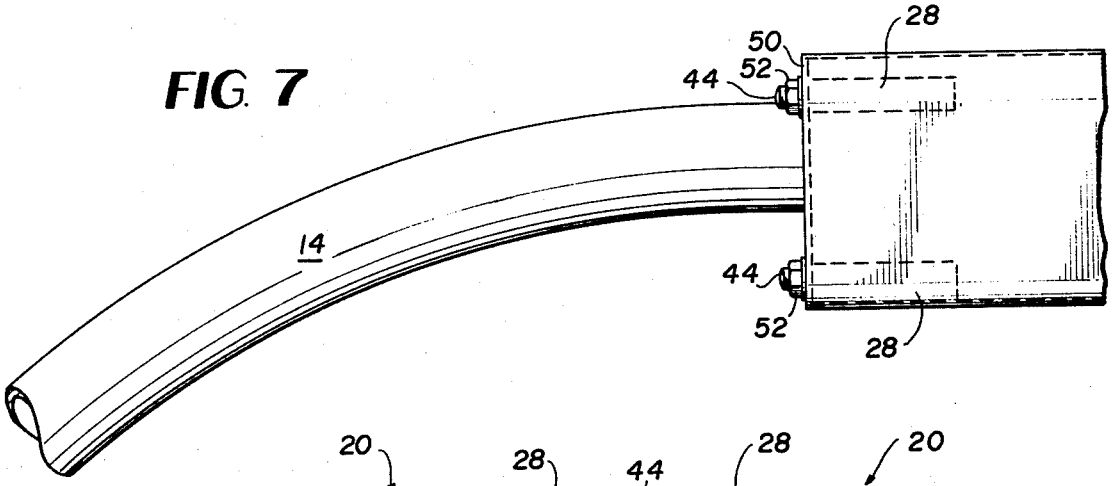
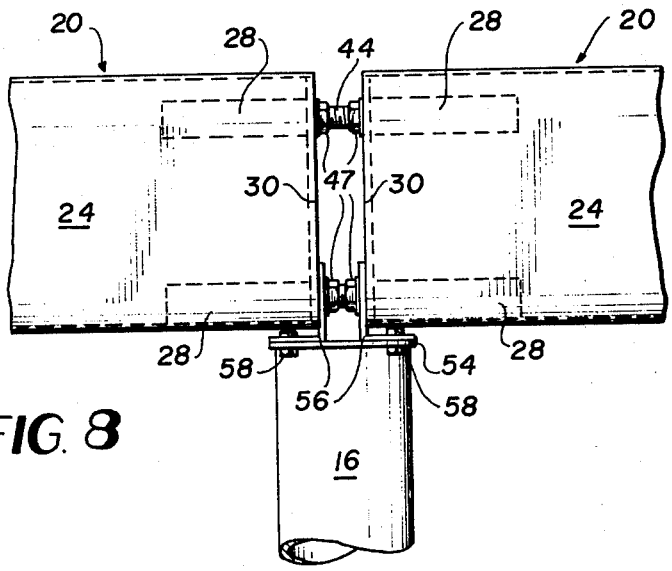
FIG. 8

LIGHTING APPARATUS

BACKGROUND OF THE INVENTION

Outdoor area lighting, especially for sports facilities such as tennis courts, poses a number of problems. The lighting level should be relatively uniform and of a high intensity over the area. The fixtures should protect the wiring, ballasts, etc., from the elements. Economy suggests that the lighting be located close to the surface to be lighted, and excess light may be objectionable in many cases to homeowners and others adjacent the highly lighted area.

Particularly in the case of tennis court lighting, the support posts should be located so as to substantially eliminate the possibility of players running into them. The lighting system must be strong enough to withstand any high wind conditions to which it may be subjected, and maintenance should be both safe and relatively easy to perform.

Heretofore, outdoor lighting systems have failed to adequately fulfill many of these requirements. Most systems comprise banks of light mounted on tall poles or tower structures. These result in inefficient light transmission and create differences in lighting intensity on the playing surface, are subjected to high wind loads, require high climbing to service, are unsightly, and often cause complaints from neighbors.

Other area lighting systems have utilized individual lights hung from cables or similar means. These systems require strong support owing to the cable tension, expose the wiring to the elements, are difficult to service, and tend to create distracting light patterns due to swinging movement even in light breezes.

SUMMARY OF THE INVENTION

The area lighting apparatus of the present invention provides solutions to the problems heretofore encountered and fulfills the requirements outlined above in a simple and effective manner.

The lighting apparatus generally comprises one or more self-supporting rigid beams formed of lightweight material such as sheet aluminum. The beams are formed in a generally triangular cross-sectional shape, with individual sections of the beam tied together end-to-end into a long span beam. The beam may be easily supported in an elevated position at extended intervals by simple support posts which are generally subjected only to vertical loading owing to the rigidity of the beam. The triangular beam is orientated with one apex thereof pointed downwardly. Fluorescent tubes or other lighting means are mounted on one or both side panels of the triangular beam and serve both as supporting and reflecting surfaces for the lighting means. The ballast for the fluorescent tubes is mounted internally of the beam through an opening in the upper panel of the beam. The wiring is also run internally of the beam and the support posts, and the ballast mounting opening is used to provide access for both end-to-end assembly of the beam sections and maintenance of the lighting means.

The beams may be mounted reasonably close to the ground to make light transmission to the playing surface efficient and uniform. The triangular beam presents a small surface to winds, reducing potential side loading on the support posts. The low elevation of the lighting fixtures and the rigid beam support makes maintenance both safe and simple. The fluorescent tubes preferably are protected from flying objects by a screen grille or diffuser.

The advantages of the lighting apparatus of the present invention are more readily appreciated by reference to the accompanying drawings and description of the preferred embodiments thereof.

BRIEF DESCRIPTION OF THE DRAWINGS

FIG. 6 is a sectional view taken generally along line 6—6 of FIG. 5;

FIG. 7 is a partial side elevational view showing the connection between a beam section and one of the end support posts;

FIG. 8 is a partial side elevational view showing the connection between a beam section and a central support post;

DESCRIPTION OF THE PREFERRED EMBODIMENTS

Figure 1:
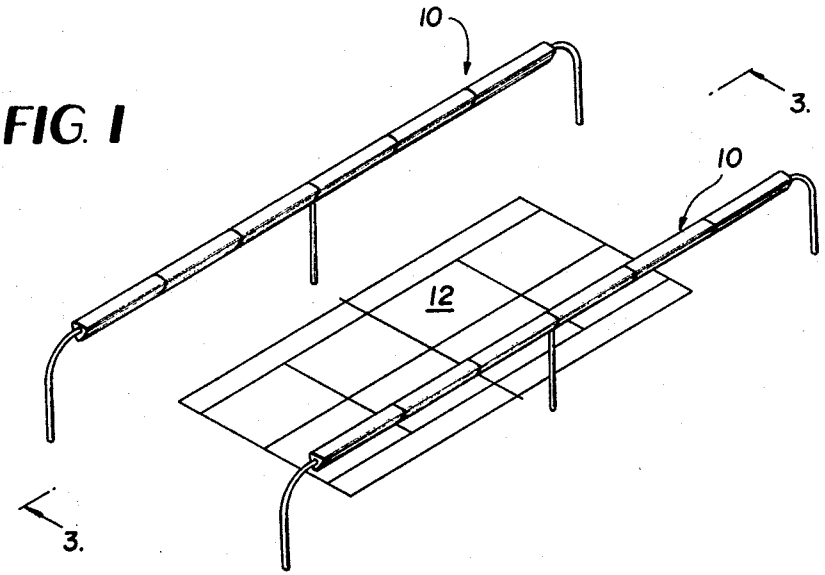
FIG. 1 is an overall perspective view of the lighting apparatus of the present invention installed adjacent to a tennis court or other playing surface.

In FIG. 1, there is illustrated the lighting apparatus 10 of the present invention in a typical application for furnishing illumination for a tennis court 12 or similar playing surface.

Figure 2:
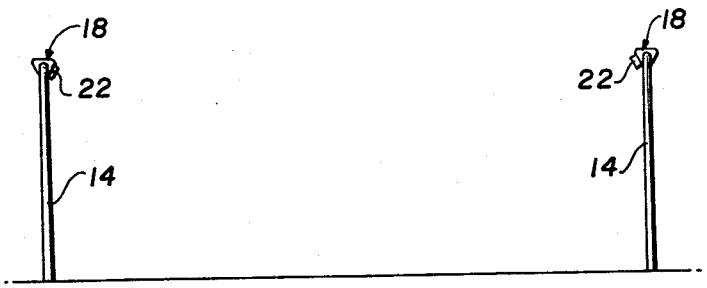
FIG. 2 is an end elevational view of the lighting apparatus shown in FIG. 1.
Figure 3:
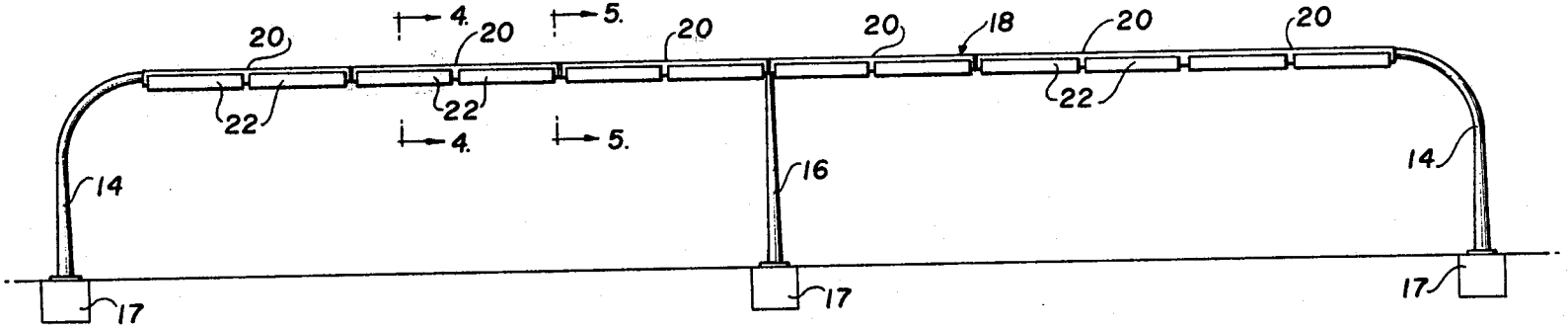
FIG. 3 is a side elevational view of the lighting apparatus taken generally along line 3—3 of FIG. 1.

As seen in greater detail in FIGS. 2 and 3, davit type end posts 14 and a center post 16, set in supporting foundations 17, provide support for a luminaire beam 18 comprising multiple lightweight structural beam sections 20 which are rigidly connected together in end-to-end relationship. Lamp units 22 are affixed to one or more side panels or faces of the beam sections 20 to provide illumination.

Figure 4:
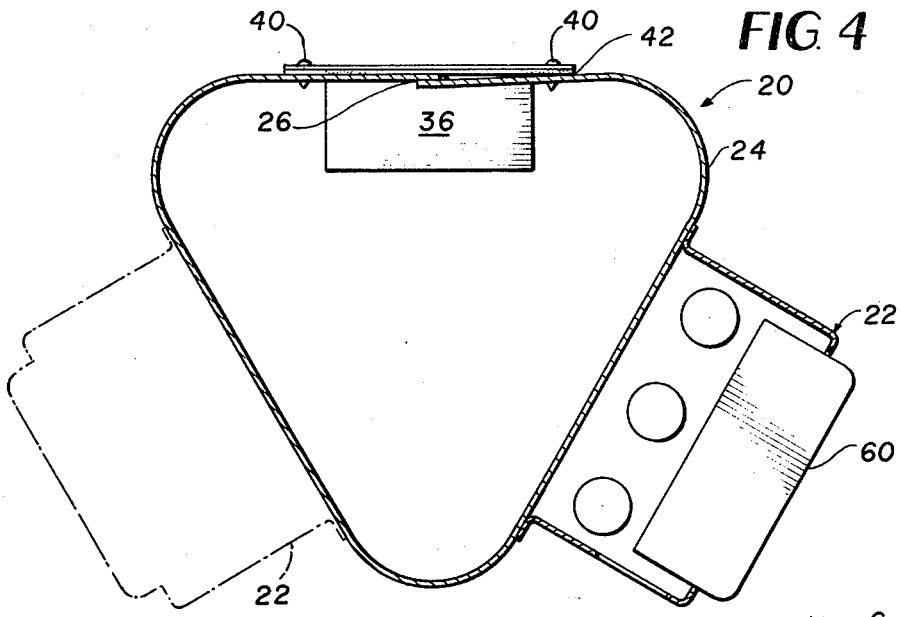
FIG. 4 is a sectional view taken generally along line 4—4 of FIG. 3.
Figure 5:
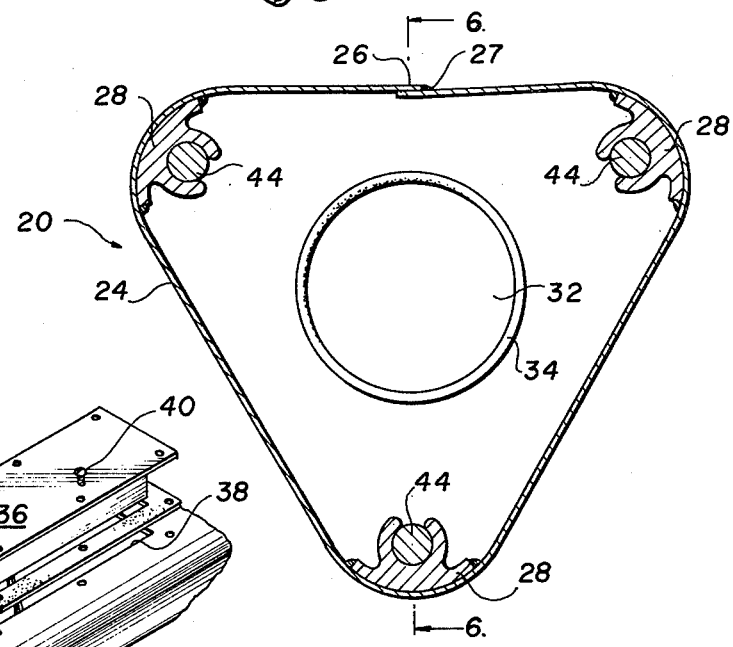
FIG. 5 is a sectional view taken generally along line 5—5 of FIG. 3.

As shown in FIGS. 4 and 5, each beam section 20 is formed from a skin 24 of any suitable sheet material, preferably sheet metal such as aluminum for lightweight and low maintenance. The skin 24 is formed into a closed tube with a polygonal cross-sectional shape which is preferably generally triangular for strength and, in most cases, is in the generally equilateral triangular shape shown in the drawings with rounded edges.

The skin 24 is securely joined together generally along the center line 26 of one panel or face of the triangle as best seen in FIG. 5 by means of a continuous weld 27 or other suitable means such as adhesive bonding or mechanical fastenings. Alternately, the skin 24 may be formed of a hollow extrusion if desired.

A tie bolt mount 28 is affixed to the inside of each apex of the skin 24 at each end of the beam section 20 by means of welding or other suitable fastening means. An end plate 30 (FIG. 6) is also preferably fastened to each end of each beam section 20 by means of welding or other suitable fastening means to aid in maintaining the cross sectional dimensions of the beam in the stress area. The end plate 30 preferably includes a cut out 32 with the edges of the cut out 32 covered by a grommet 34 or similar means to eliminate sharp rough edges.

The length of each beam section 20 is preferably slightly greater than a multiple of the length of one of the fluorescent lamp units 22 that are to be mounted on the beam section. As shown in FIG. 3, each beam section 20 is slightly longer than the two lamp units 22 mounted thereon.

Figure 9:
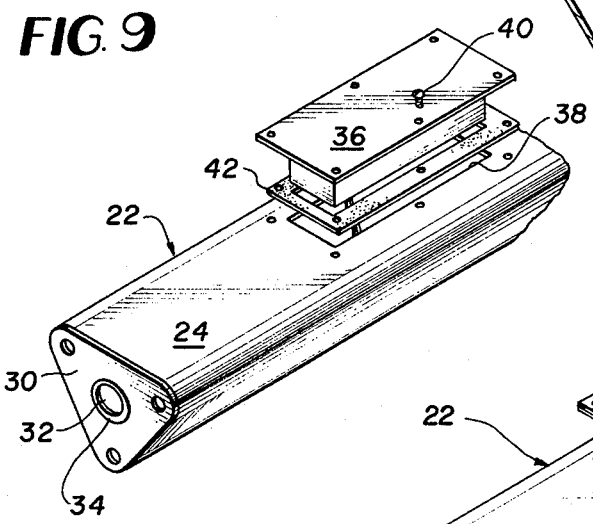
FIG. 9 is a perspective view illustrating the assembly of a ballast in a beam section.

A ballast 36 for each of the lamp units 22 is mounted through a hold 38 cut in the upper panel or face of the beam section 20 and, as shown in FIG. 9, is preferably attached by means of screws 40, and a gasket 42 is provided for rain and water protection.

Referring to FIG. 6, the beam sections 20 are joined together in end-to-end relationship to form the completed elongated luminarie beam 18 by means of tie bolts 44, along with nuts 46, adjusting nuts 47 and washers 48. The tie bolts 44 are first inserted into the tie bolt mounts 28 in one beam section 20 and secured by means of nuts 46 and 47 and washers 48. The second nut 47 and a washer 48 is then threaded onto each tie bolt 44 and the second beam section 20 is placed over the tie bolts 44, and the second nuts 46 and washers 48 are threaded onto the tie bolts 44. Access for tightening and adjusting the nuts 46 is made through the ballast mounting holes 38 (FIG. 9) in the beam sections 20. The completed luminaire beam 18 is assembled into a straight, rigid structure by adjustment and tightening of the nuts 46 and lock-nuts 47 as required.

The luminaire beam 18 is attached to the davit-type end posts 14 in the manner shown in FIG. 7. The davit-type post 14 has a plate 50 welded or otherwise attached to its upper end. The plate 50 is shaped to abut the end plate 30 of a beam section 20 and includes holes aligned with the tie bolts 44. Nuts 52 are threaded onto the tie bolts 44 and tightened to fasten the beam 18 to the davit post 14.

The beam 18 is fastened to a center or intermediate post 16 in the manner shown in FIG. 8. The center post 16 is shown terminating in an end plate 54 secured thereto in any suitable manner. Brackets 56 are attached to the end plate 54 by means of bolts 58. The upturned ends of brackets 56 are slotted to fit over the lower tie bolt 44 between two beam sections 20. The nuts 47 are tightened over the brackets 56 to provide a secure attachment.

Figure 10:
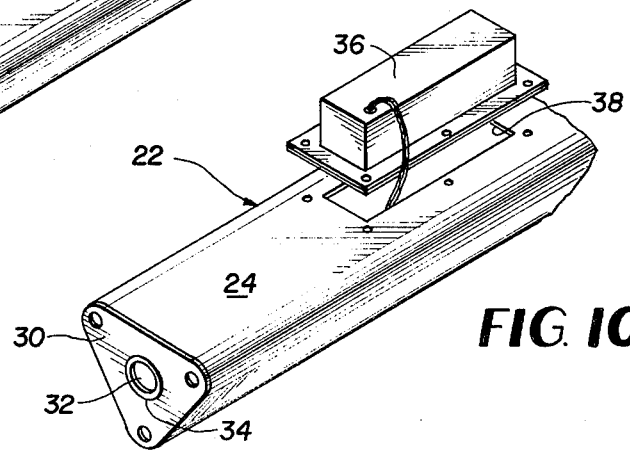
FIG. 10 is a perspective view similar to FIG. 9, illustrating a ballast mounted in a maintenance position.

The luminaire beam 18 is preferably mounted with one apex of the triangular beam pointing downwardly. Fluorescent lamp units 22 or other suitable lighting means are mounted in any suitable manner to one or both of the downwardly directed side panels or faces of the beam 18 which serve both as mounting and reflecting means for the lamp units. Wiring for the lamp units (not shown) is preferably conveniently strung inside the beam 18 and through the supporting posts 14 and 16 as required. The ballasts 36 may be removed from their mounting holes 36 and reversed as shown in FIGS. 9 and 10 for installation wiring or servicing as required.

Diffuser baffles 60 or screens preferably are mounted on the side panels of the beam section 20 as shown in FIG. 4 to protect the lamps 22 from damage from balls or flying objects and may be used additionally to direct light toward the desired area and prevent potentially objectionable lighting of nearby areas.

As seen in FIGS. 1, 2 and 3, the luminaire beams 18 may be assembled to provide long span open areas requiring a minimum number of supporting posts 14 and 16. The luminaire beams 18 may be mounted relatively close to the ground and adjacent to the lighted area such as a tennis court 12. As an illustrative example, the lighting apparatus 10, as illustrated in FIG. 1, may comprise beam sections 20 of a length of approximately twenty feet, each supporting two standard eight foot lamp units 22. The desired lighting intensity over the entire area of a tennis court 12 or other playing surface may be provided with the use of the present lighting apparatus with a minimum of expenditure both in construction and illumination cost. Potentially objectionable overlighting of adjacent areas is considerably reduced or eliminated.

The features of the wiring being internal of the lighting apparatus 10, the lamp units 22 being mounted relatively close to the ground, and on a rigid beam, with maintenance access through the ballast mounting holes 38, make maintenance both safe and simple to perform compared to other known area lighting systems.

The minimum profile of the lighting apparatus 10 that is presented for wind-loading reduces the structural requirement in erecting the system and reduces the potential for damage to the system and surrounding property in the case of severe storms or the like.

What is claimed is:

1. Lighting apparatus comprising:

an elongated beam of light reflective material and of substantially polygonal cross section, lighting means mounted on the exterior of said beam, and means connected to said beam for supporting it in an elevated, substantially horizontally extending position.

2. Lighting apparatus comprising:

an elongated beam of substantially triangular cross section with a downwardly facing apex and adjacent downwardly facing oblique side panels of light reflective material, first lighting means mounted on the exterior of one of said side panels, and means connected to said beam for supporting it in an elevated, substantially horizontally extending position.

3. The lighting apparatus of claim 2 wherein said beam is formed of sheet material and comprises a plurality of elongated beam sections joined together in end-to-end relation.

4. The lighting apparatus of claim 3 wherein second lighting means are mounted on the exterior of the other of said side panels, whereby said side panels serve as support means and reflecting means for said lighting means.

5. The lighting apparatus of claim 3 wherein each of said beam sections comprises tie member mounting means disposed therein and secured thereto at the apexes thereof and adjacent the ends thereof, an end plate secured to at least one end thereof, said end plate having apertures therethrough, and tie members extending through said mounting means and end plates to rigidly secure said beam sections together.

6. The lighting apparatus of claim 5 wherein each beam section has an opening adjacent to each end thereof to provide access to the interior of said beam sections and said tie member mounting means and tie members.

7. The lighting apparatus of claim 6 wherein each beam section has an opening therein for receiving ballast and wiring for said lighting means.

8. The lighting apparatus of claim 7 wherein said lighting means comprises a plurality of generally hoizontally extending fluorescent lamps and baffle means therefor.

9. The lighting apparatus of claim 5 wherein said beam supporting means comprises end support posts connected to the outer ends of end beam sections.

10. The lighting apparatus of claim 9 wherein said beam supporting means further comprises an intermediate support post connected to the ends of two adjacent, intermediate beam sections.

11. The lighting apparatus of claim 5 wherein said tie members comprise means to adjust the spacing between adjacent beam sections.

* * * * *